US009346572B2

(12) United States Patent
Leppert

(10) Patent No.: US 9,346,572 B2
(45) Date of Patent: May 24, 2016

(54) STRAPPING APPARATUS

(71) Applicant: FROMM HOLDING AG, Cham (CH)

(72) Inventor: Klaus Leppert, Seebach (DE)

(73) Assignee: FROMM HOLDING AG, Cham (CH)

( * ) Notice: Subject to any disclaimer, the term of this patent is extended or adjusted under 35 U.S.C. 154(b) by 85 days.

(21) Appl. No.: 14/303,253

(22) Filed: Jun. 12, 2014

(65) Prior Publication Data

US 2014/0311363 A1 Oct. 23, 2014

Related U.S. Application Data

(63) Continuation of application No. PCT/EP2012/005294, filed on Dec. 20, 2012.

(51) Int. Cl.
*B65B 13/22* (2006.01)
*B65B 13/02* (2006.01)

(52) U.S. Cl.
CPC ..... *B65B 13/22* (2013.01); *B65B 13/025* (2013.01)

(58) Field of Classification Search
CPC ..... B65B 13/22; B65B 13/025
USPC ..... 100/29, 32; 140/93.2; 242/422.6, 422.8
See application file for complete search history.

(56) References Cited

U.S. PATENT DOCUMENTS 5,653,095 A * 8/1997 Stamm ..... B65B 13/327 100/32
6,328,087 B1 * 12/2001 Finzo ..... B65B 13/22 100/32
2004/0206251 A1 * 10/2004 Nix ..... B65B 1/28 100/29

FOREIGN PATENT DOCUMENTS

DE 35 25 647 A1 1/1987
DE 10026200 A1 * 11/2001 ..... B65B 13/187
EP 0 664 256 A1 7/1995
GB 2 098 163 A 11/1982
WO WO 2009/129636 A1 10/2009

OTHER PUBLICATIONS

The PCT International Search Report mailed May 7, 2013 by ISA/EP and issued in a related PCT International Patent Application No. PCT/EP2012/005294, filed Dec. 20, 2012 (3 pages).

* cited by examiner

*Primary Examiner* — Jimmy T Nguyen
(74) *Attorney, Agent, or Firm* — Robert P. Michal, Esq.; Carter, DeLuca, Farrell & Schmidt LLP

(57) ABSTRACT

A strapping apparatus for strapping a tensioning strap around a packaging item includes a frictional wheel that operates against a support to tighten the tensioning strap. The frictional wheel is operatively connected to a drive unit and can be lifted from the support by a swiveling lever. The swiveling lever includes an interrupting element to interrupt the path of action between the frictional wheel and the drive unit so as to be able to lift the frictional wheel in an unloaded state from the tensioning strap.

9 Claims, 3 Drawing Sheets

STRAPPING APPARATUS

CROSS-REFERENCE TO RELATED APPLICATIONS

This is a Continuation application under application under 37 CFR 1.53(b) of PCT International Application No. PCT/EP2012/005294, filed Dec. 20, 2012 entitled STRAPPING APPARATUS, which claims the benefit of German Application Serial No. 10 2011 122 157.7, the entire contents of each of which are herein incorporated by reference.

BACKGROUND INFORMATION

The invention relates to a strapping apparatus for strapping a tensioning strap around a packaged item, said apparatus including a frictional wheel which works against a support for tightening the named tensioning strap, wherein the frictional wheel is operatively connected to a drive and is liftable from the support by means of a pivot lever.

It is known, for example, to loop a plastics material or metal strap around a packaged item, a first, free end of the strap then forming a bottom strap at a connecting point and the other end of the strap, after forming the loop, forming a top strap at the connecting point. The top strap is then connected to the bottom strap at the connecting point, either, for example, in the case of metal straps as a result of clamping or in particular in the case of plastic material straps as a result of welding.

The overlapping top belt is then subsequently cut off close to the connection created in this manner such that the strap guided around the packaged item forms a ring.

So that said ring abuts closely against the packaged item, the strap has to be tightened tightly prior to forming the connection. To this end, it is known to guide the strap through the strapping apparatus between a frictional wheel and a support. The frictional wheel is then lowered onto the strap and made to rotate, as a result of which the strap is pulled through between the frictional wheel and the support.

At the end of the tightening operation, the addressed connection between the top and the bottom strap is then produced and the frictional wheel can then stop exerting a tensile force onto the strap.

As a result of the tensile force exerted by the frictional wheel onto the strap up to this point, in this case both the point of application of the force of the friction wheel on the strap and the drive elements connected upstream of the frictional wheel are under load. There is consequently the need to be able to bring about a load alleviation at this point in order to make it easier to handle the strapping apparatus then and also in the case of the next steps to be able to operate at little load and consequently in as wear-free a manner as possible.

In this case, for eliminating the load it is known to lift the frictional wheel up from the strap because, as a result, the load can be removed both from the connecting point between the frictional wheel and the strap and also from the drive train of the frictional wheel.

However, it has been shown that as a result of the forces or loads which act until the frictional wheel is lifted off and also have the effect of tensioning the drive train, the lowering or lifting mechanism for the frictional wheel can sometimes even jam, which restricts operating reliability.

SUMMARY

It is, consequently, an object of the present invention to develop further a strapping apparatus as specified above to the effect that it becomes more operationally reliable with regard to the aspect addressed.

The object is achieved according to the invention in that the pivot lever arm is provided with an interrupting element in order to interrupt the path of action between the frictional wheel and the drive.

As the load on the frictional wheel originates from the tension of the strap on the one hand but from the drive or drive train held against it on the other hand, the load or pretensioning can be reduced as a result of the interruption in the path of action in the drive train and the frictional wheel can be lifted off in a load-free and consequently problem-free manner by means of the pivot lever arm.

By the pivot lever arm in this case not only bringing about the lifting-off movement of the frictional wheel, but also being provided directly with the interrupting element, it is possible to use fewer components overall such that a lower production expenditure for fewer parts on the one hand and inapplicable assembly expenditure on the other hand also enable a strapping apparatus to be produced in an even better value manner than if, for example, a separate element were to be provided just for the interruption in the path of action as well as a separate element just for the lifting-off movement.

In the case of a preferred embodiment of the invention, a gear unit is provided in the path of action between the frictional wheel and the drive and the interrupting element acts on an element of said gear unit. In particular, it is possible, for example, for the interrupting element to separate a coupling or the like.

In a preferred manner, however, the gear unit is a planetary gear unit. In the case of the planetary gear unit, there is an intermediate element between the drive and the output. If the drive is connected as usual to the sun wheel and the output is connected to the hollow wheel, the intermediate element is the planetary carrier with the planetary gear wheels sitting thereon. If, on the other hand, the output is effected by means of the planetary carrier with the planetary wheels, the intermediate element is formed by the hollow wheel. In theory, the sun wheel could also serve as the intermediate element if the drive and output are effected by means of the hollow wheel or the planetary carrier. However, this design is applied only rarely on account of the small transmission ratio in this case.

The intermediate element is normally supported with respect to a housing in order to be able to conduct through torque.

The gear unit element which interacts according to the invention with the interrupting element of the pivot lever arm is therefore in each case the intermediate element of said planetary gear unit.

To this end, it is proposed in particular that the intermediate element includes an external toothing and the interrupting element on the pivot lever aim is a support toothing that corresponds thereto.

The design results in that by means of the pivot lever arm the support toothing and the external toothing of the intermediate element are able to be moved out of engagement and the intermediate element is then freely rotatable. Should the interrupting element be actuated therefore, load originating from the drive ends operatively at the intermediate element which is then rotated by the load. No more action is therefore forwarded then beyond the intermediate element. If, on the other hand, the support toothing on the pivot lever arm engages with the external toothing of the intermediate element, the intermediate element is fixed in its rotation and the action of the drive is forwarded through the planetary gear unit onto the frictional wheel.

As an alternative to an external toothing on the intermediate element and a support toothing on the pivot lever arm, a frictional surface on the intermediate element and a type of brake shoe on the pivot lever arm would also be possible.

In the case of a preferred embodiment of the invention, the gear unit is arranged in or on a bearing block, the bearing block being tiltable by means of the pivot lever. As a result of the tilting of the bearing block, the gear unit can be tilted simultaneously in this case and the frictional wheel which is connected thereto can also be lifted off at the same time.

So as not to lift off the frictional wheel in a jerky manner as a result of tilting the bearing block, it is proposed to arrange an elastic means, for example a spring or a helical spring, between the pivot lever and the bearing block.

In the opposite tension the elastic means also has the effect of pivoting the pivot lever back automatically in the case of its non-actuation and consequently engaging the support toothing with the external toothing of the planetary gear unit intermediate element and consequently ensuring the operative connection between the drive and the frictional wheel. This is a particularly operationally reliable solution.

In order to press the frictional wheel at a certain pretension onto the tensioning strap to be tightened, it is additionally proposed to provide a resetting spring, which is supported at least in each case indirectly on the bearing block on the one side and on the housing on the other side, between the bearing block and the housing of the strapping apparatus.

For a space-saving design of the above-described invention, it is also additionally proposed to actuate the pivot lever by means of a connecting rod. This is additionally a method of design which is proved to be operationally reliable.

BRIEF DESCRIPTION OF THE DRAWINGS

Further advantages and features of the invention are produced from the following description of an exemplary embodiment, in which.

DETAILED DESCRIPTION

Figure 1:
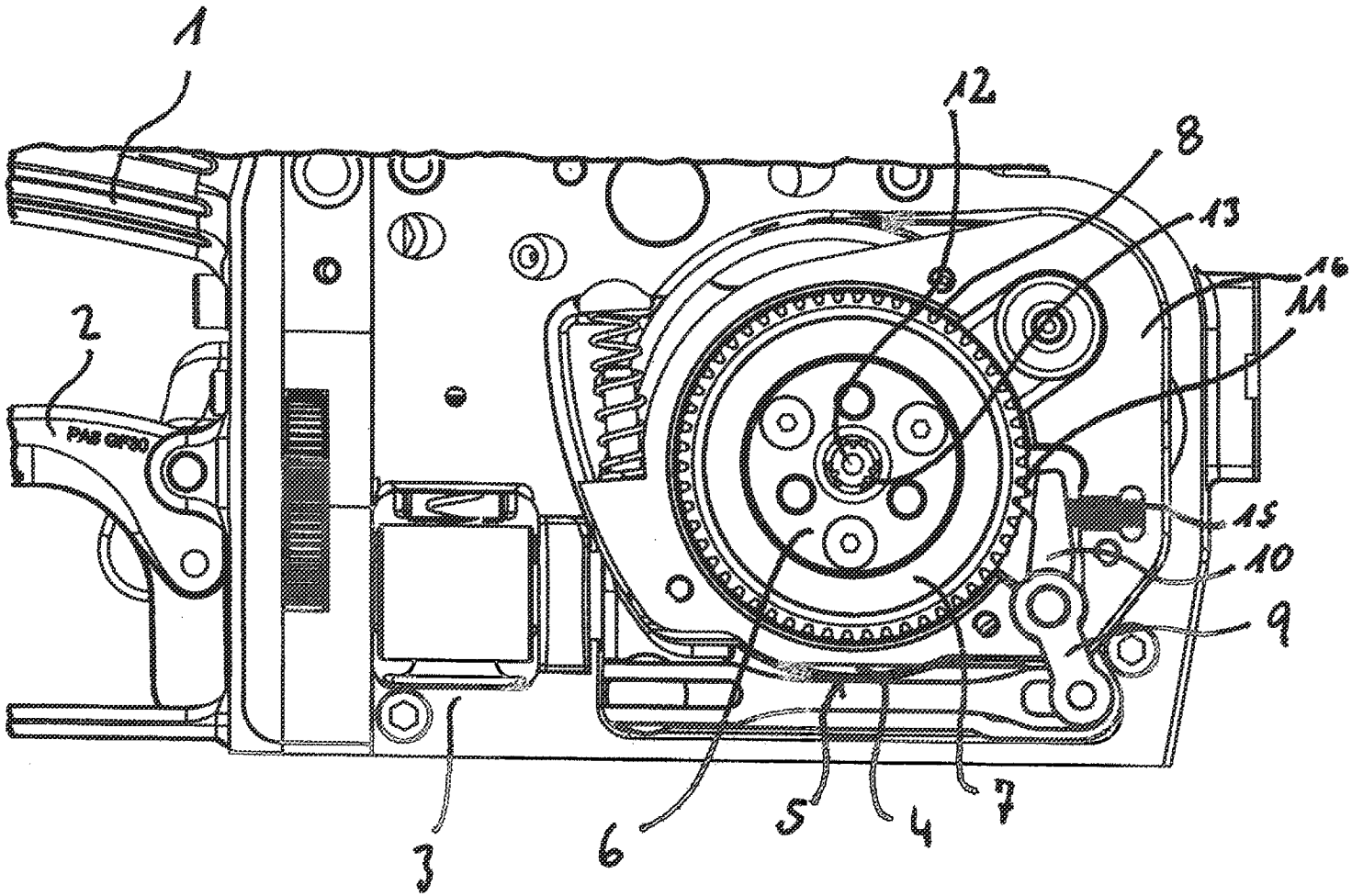
FIG. 1 shows the side view of a strapping apparatus with a frictional wheel operatively connected to a drive and in abutment against a support.

The part sectional view of a strapping apparatus can be seen in FIG. 1. A handle 1, only shown in part, which is utilized for holding the apparatus is situated on the strapping apparatus. Below the handle is situated an actuating lever 2 which is pulled in the direction of the handle in order to effect some operating steps of the strapping apparatus. This is explained below.

A tensioning strap (not shown) is initially looped around a packaged item (not shown). The two ends of the loop, in this case, lie at the position for a connecting point 3 where the two ends will be welded together, clamped together or connected together in a similar manner.

So that the tensioning strap lies tightly around the packaged item, prior to welding it is tightened by means of a frictional wheel 4, which in this case operates against a support 5, by being pressed in a rotating manner onto the top surface of the tensioning strap and consequently keeping hold of it and pulling it in a rotational direction.

The frictional wheel 4 is driven by means of the hollow wheel (not visible) of a planetary gear unit 7. In the case of said design, the planetary carrier 6 is provided with a corresponding external toothing 8 in order to fix or release the planetary carrier 6 in its rotation. By way of its pivot lever arm 10, a pivot lever 9 engages in the external toothing 8 by means of a support toothing 11 which is mounted on the end of the pivot lever arm 10 and thus prevents the planetary carrier 6 from being able to rotate. When the support toothing 11 engages in the external toothing 8 of the planetary carrier 6, the planetary carrier 6 is therefore fixed and a rotation of the drive 12 is transmitted to the hollow wheel by means of the planetary wheels 13 and consequently to the frictional wheel 4 which is connected thereto.

In the case of a comparable design, the output onto the frictional wheel 4 can be effected as an alternative to this by means of the planetary carrier. In the case of this comparable design, the hollow wheel is then provided with a corresponding external toothing in order to fix or release the hollow wheel in its rotation. When the support toothing engages in the external toothing of the hollow wheel, the hollow wheel is therefore fixed and a rotation of the drive is transmitted by means of the planetary wheels to the planetary carrier and consequently to the frictional wheel which is connected thereto. Consequently a rotation of the drive is transmitted by means of the planetary wheels of the planetary gear unit and from the planetary gear unit by means of the planetary wheel carrier to the frictional wheel 4.

The frictional wheel, in a lowered state, then pulls the tensioning strap tightly around the packaged item until the tensioning strap is finally connected, preferably welded to form a loop running around the packaged item. The strapping apparatus can then be removed from the tensioning strap, the contact between the frictional wheel and the tensioning strap, however, having first to be released.

As a result of the friction applied to the tensioning strap, the tensioning strap is tensioned with the frictional wheel to a certain extent and as the drive for the frictional wheel is also correspondingly tensioned, difficulties can occur when releasing the frictional wheel from the tensioning strap.

In order to overcome the difficulties, the transmission of the load from the drive to the frictional wheel is interrupted.

Figure 2:
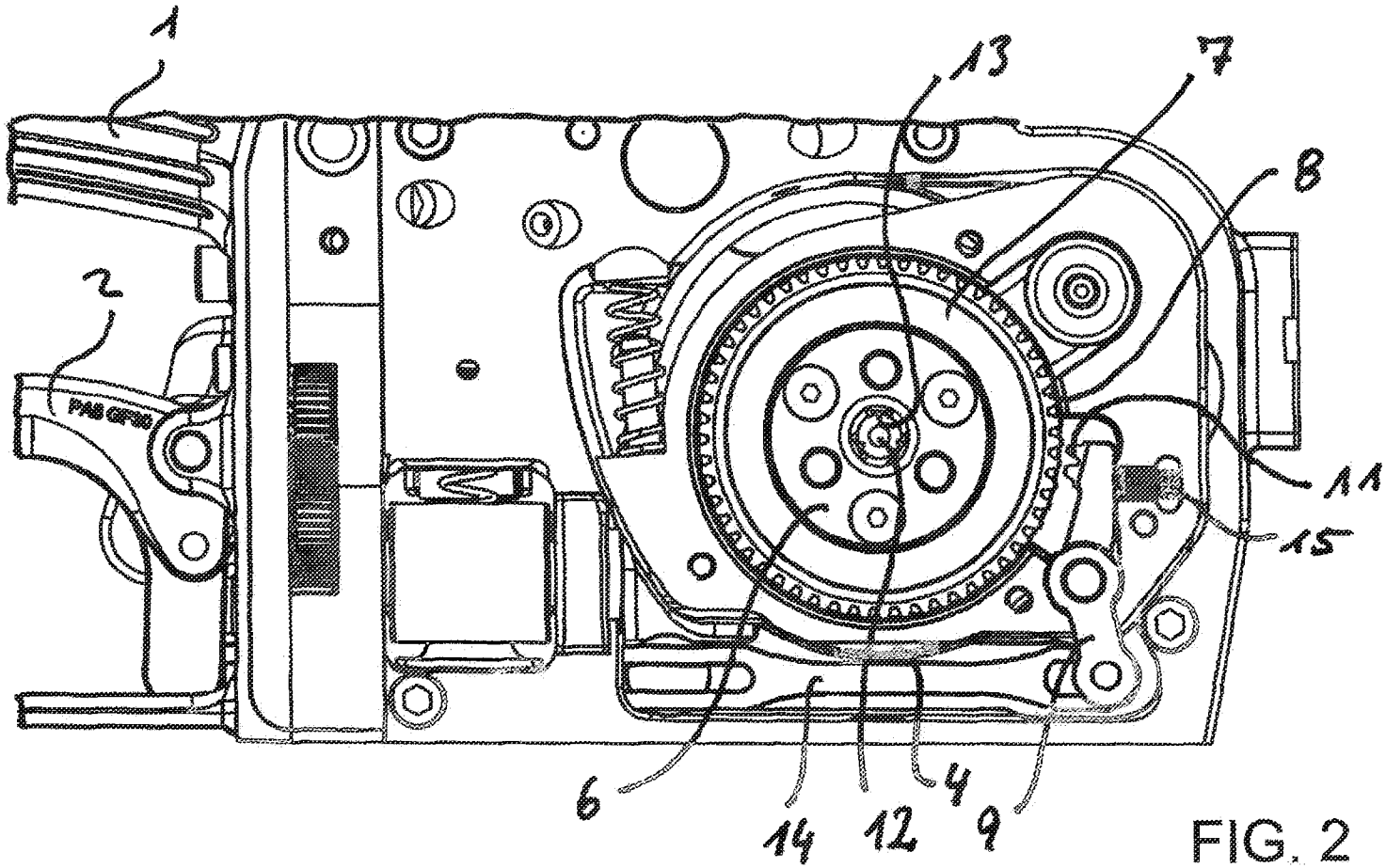
FIG. 2 shows a strapping apparatus according to FIG. 1 with operative separation between the frictional wheel and the drive.

To this end, as shown in FIG. 2, the actuating lever 2 is pulled in the direction of the handle 1. In this case, the pivot lever 9 is actuated by means of a connecting rod 14 such that the support toothing 11 on the pivot lever arm 10 is pivoted out of the external toothing 8 on the planetary carrier 6. As a result, the planetary carrier 6 is then freely rotatable.

If a rotation were then to be brought into the planetary gear unit 7 by means of the drive 12, the planetary wheels 13 would rotate in particular the planetary carrier 6, but no longer the hollow wheel with the frictional wheel 4 fastened thereto. Consequently, the path of action between the frictional wheel 4 and the drive 12 is interrupted. A load transmitted from the drive 12 to the frictional wheel 4 is also interrupted in the path of action in the same way.

Load possibly still present in the path of action or pretension resulting therefrom is consequently reduced by means of a possibly only slight rotation of the planetary carrier 6 and the frictional wheel 4 is then no longer under load or pretension.

In the case of an alternative design as described above, by actuating the pivot lever the support toothing is moved out of engagement from an external toothing on the hollow wheel which consequently is freely rotatable. If, then, in the alternative design, a rotation of the drive is brought into the planetary gear unit, the hollow wheel is rotated by means of the planetary wheels, but no longer the planetary carrier on which, in the case of the alternative design, the frictional wheel is fastened. Consequently, in the case of the variant, the path of action between the frictional wheel and the drive is interrupted in a comparable manner along the path of action, at the same time load still present in the path of action or pretension resulting therefrom being reduced by means of a possibly only slight rotation of the hollow wheel and the frictional wheel is released from load or pretension.

Figure 3:
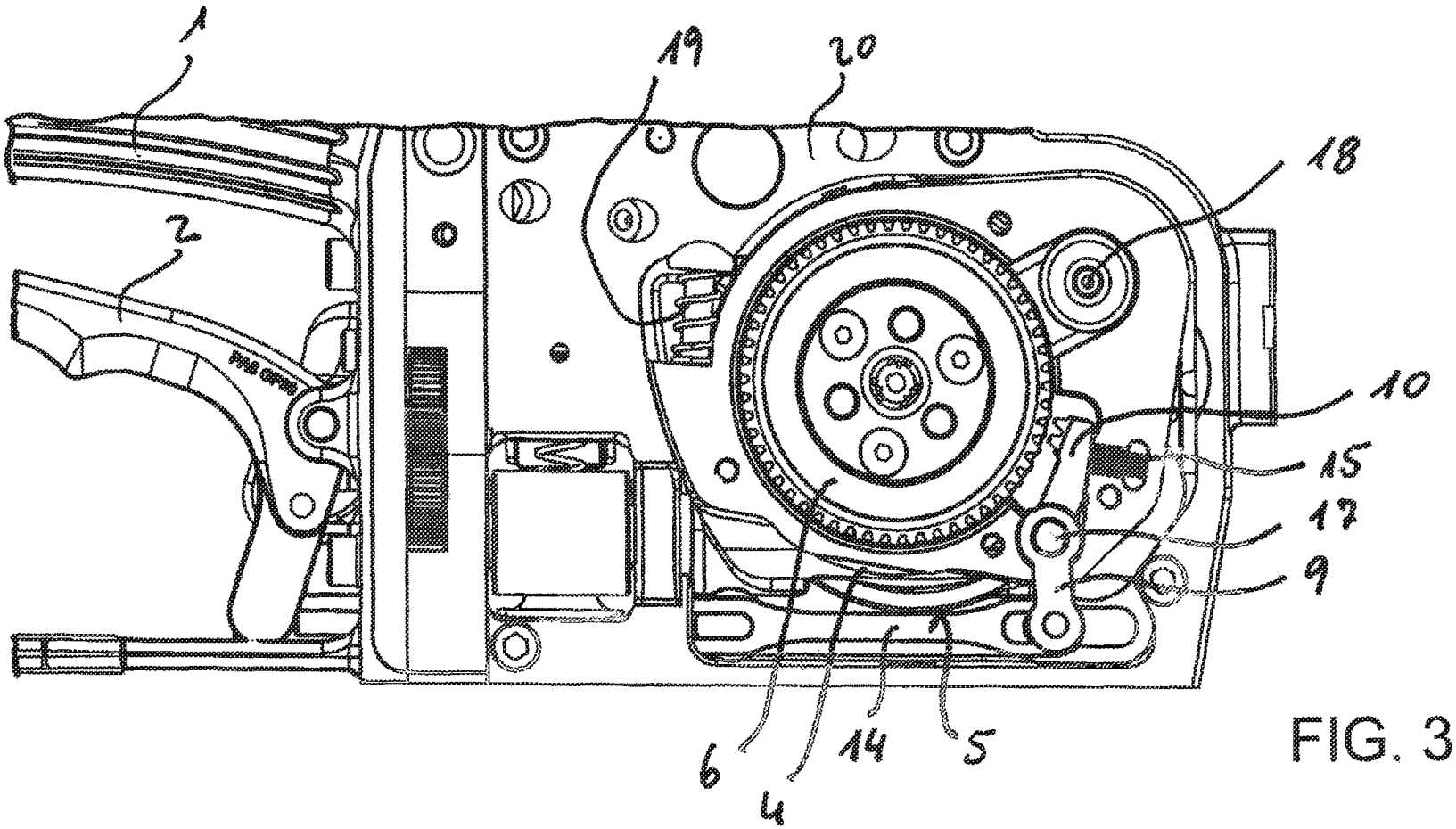
FIG. 3 shows a strapping apparatus according to FIG. 2 additionally with the frictional wheel lifted off the support.

If the actuating lever 2, as shown in FIG. 3, is then pulled even further upward in the direction of the handle 1, in the case of the two alternative designs described, the pivot lever 9 is also moved further to the side by means of the connecting rod 14. The pivot lever arm 10, in this case, initially compresses an elastic means in the form of a helical spring 15 until it abuts against a bearing block 16 on which or in which the planetary gear unit 7 is rotatably mounted.

If the actuating lever 2 is actuated further, the connecting rod 14 is moved further to the side. In this case, the pivot lever 9, however, cannot pivot any further but the force applied by the connecting rod 14 is transmitted by means of the pivot axis 17 of the pivot lever 9 to the bearing block 16 and the bearing block pivots thereupon about a pivot axis 18. As a result, the planetary gear unit situated on the bearing block 16 is also pivoted and thus the frictional wheel 4 which is flange-connected thereto is lifted up from the support 5 and the tensioning strap (not shown) located between the frictional wheel and the support is able to be removed.

The pivoting of the bearing block 16 about the axis of rotation 18 is effected, in this case, against the force of a resetting spring 19 which is supported on the one side on the bearing block 16 and on the other side on the housing 20 of the strapping apparatus.

Afterwards, in order to return back into the start position, the actuating lever 2 is released again and consequently also the connecting rod which is moved by the actuating lever.

As a result of releasing the connecting rod 14, on account of the resetting spring 19 the bearing block 16 is initially pivoted back down again, as a result of which the frictional wheel 4 is also pressed back onto the support 5.

In this case, the pivot lever 9 is also pivoted back with regard to the bearing block 16 as a result of the helical spring 15 and the support toothing 11 on the pivot lever arm 10 re-engages with the external toothing 8 on the planetary carrier 6. Consequently, the planetary carrier 6 is fixed again in its rotational position and rotation brought from the drive 12 into the planetary gear unit 7 is to be transmitted by means of the planetary wheels 13 to the frictional wheel 4 again.

In the case of the alternative design which was discussed above with reference to the external toothing on the hollow wheel, the hollow wheel would be fixed in its rotational position by means of the support toothing and rotation brought from the drive into the planetary gear unit would be transmitted to the frictional wheel again by means of the planetary carrier which is then incorporated again in the path of action.

Consequently, the frictional wheel 4 is then able again in each case to apply the desired tensile force to a tensioning strap which is situated between the frictional wheel and the support 5.

If a connection as described above is then produced again at the connecting point 3, the support toothing 11 can be moved out of engagement again and the frictional wheel can be moved upward in a load-free manner as described above.

What is claimed is:

1. A strapping apparatus for strapping a tensioning strap around a packaged item, comprising:

a frictional wheel, a support against which said frictional wheel operatively engages for tightening the tensioning strap, a drive, the frictional wheel being operatively connected to the drive and a pivot lever, the frictional wheel being liftable from the support by means of the pivot lever, and a connecting rod being operatively coupled to the pivot lever and being movable between first and second positions, wherein the pivot lever is provided with an interrupting element for interrupting a path of action between the frictional wheel and the drive, and wherein the connecting rod reciprocates between the first and second positions.

2. The strapping apparatus as claimed in claim 1, further comprising a planetary gear unit in the path of action between the frictional wheel and the drive, and the interrupting element being engageable with an element of the planetary gear unit.

3. The strapping apparatus as claimed in claim 2, wherein the planetary gear unit element which interacts with the interrupting element of the pivot lever is a planetary carrier of said planetary gear unit.

4. The strapping apparatus as claimed in claim 2, wherein the planetary gear unit element which interacts with the interrupting element of the pivot lever is a hollow wheel of said planetary gear unit.

5. The strapping apparatus as claimed in claim 3, wherein the planetary gear unit comprises an external toothing and the interrupting element on the pivot lever comprises a support toothing which corresponds to and is engageable with the external toothing of the planetary gear unit.

6. The strapping apparatus as claimed in claim 2, wherein the planetary gear unit is mounted at least one of in or on a bearing block which is tiltable by actuation of the pivot lever.

7. The strapping apparatus as claimed in claim 5, further comprising an elastic device arranged between the pivot lever and a bearing block.

8. The strapping apparatus as claimed in claim 5, further comprising a resetting spring which is supported on a bearing block and on a housing is disposed between the bearing block and the housing of the strapping apparatus.

9. The strapping apparatus as claimed in claim 1, wherein the pivot lever is actuatable by the connecting rod.

* * * * *